United States Patent [19]

London et al.

[11] Patent Number: 4,704,976

[45] Date of Patent: Nov. 10, 1987

[54] METHOD AND APPARATUS FOR FORMING AND PRESENTING BIAS CUT GUSSETS IN THE FORMATION OF PANTY HOSE GARMENTS

[75] Inventors: J. Reid London, Winston-Salem; Cecil R. Bell, Jr., Pinnacle; A. Russell Edwards, Winston-Salem; Willie M. Lathery, Germanton; Lee A. Efird, Kernersville, all of N.C.; Richard M. Porter, Hartsville, S.C.; Stephen K. Shaw, Winston-Salem, N.C.; Thomas J. Costello, Kernersville, N.C.; August A. Pike, Winston-Salem, N.C.; Donald G. Bell, Mocksville, N.C.; Harold Setliff, High Point, N.C.

[73] Assignee: Sara Lee Corporation, Winston-Salem, N.C.

[21] Appl. No.: 923,584

[22] Filed: Oct. 27, 1986

Related U.S. Application Data

[62] Division of Ser. No. 838,314, Mar. 10, 1986, Pat. No. 4,640,162.

[51] Int. Cl.[4] ..... D05B 21/00; D05B 1/00; A41B 11/04; B21D 43/00

[52] U.S. Cl. ..... 112/262.2; 112/262.3; 2/243 B; 2/409; 29/2.25

[58] Field of Search ..... 112/262.3, 262.2, 262.1, 112/121.15; 2/409, 401, 243 B; 29/2.25

[56] References Cited

U.S. PATENT DOCUMENTS

| | | | |
|---|---|---|---|
| 4,047,272 | 9/1977 | King et al. | 29/2.19 |
| 4,122,555 | 10/1978 | Safrit et al. | 2/401 |
| 4,188,898 | 2/1980 | Bell Jr. et al. | 112/262.1 |
| 4,267,785 | 5/1981 | Osho | 112/121.12 |
| 4,539,924 | 9/1985 | Bell, Jr. et al. | 112/121.15 X |

*Primary Examiner*—H. Hampton Hunter

*Attorney, Agent, or Firm*—Charles Y. Lackey; William S. Burden

[57] ABSTRACT

A system for forming substantially diamond-shaped gussets to be used in the production of panty hose garments wherein the gussets are formed by severing a circular knit tube along a bias angle of approximately 30° subsequently to form strips having a width corresponding to the desired width of a gusset. The strip then is severed along a prescribed angle of approximately 30° to define a gusset wherein the fabric wales extend parallel to a line extending from one point to the diagonally opposite point of the diamond-shaped gusset. The gusset is then transferred and oriented for subsequent sewing to hosiery blanks in the forming of panty hose.

9 Claims, 11 Drawing Figures

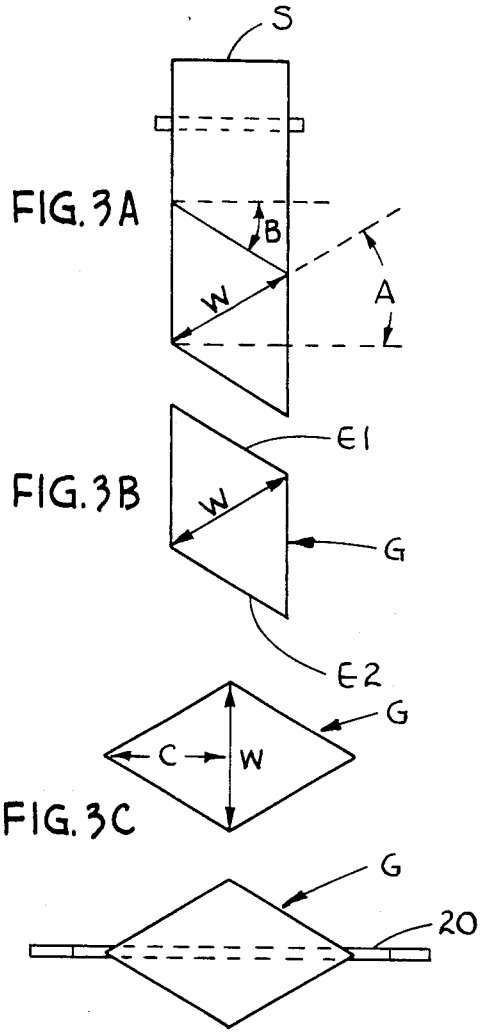
FIG. 3A
FIG. 3B
FIG. 3C
FIG. 3D
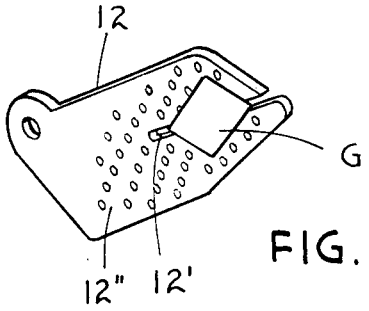
FIG. 7
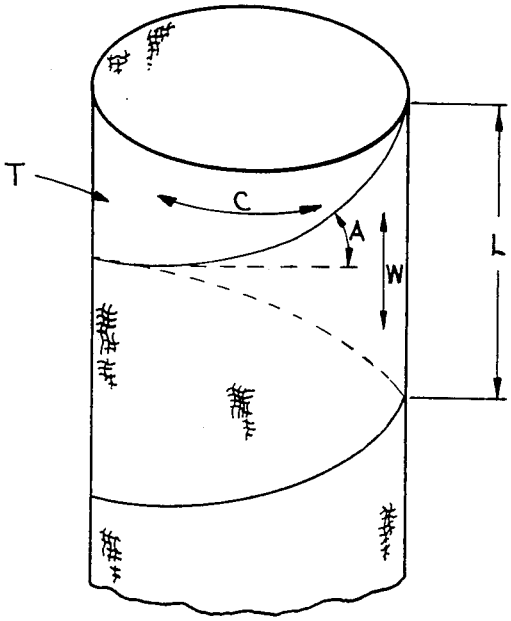
FIG. 1
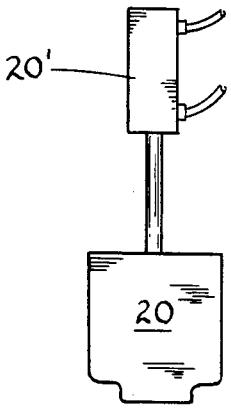
FIG. 8
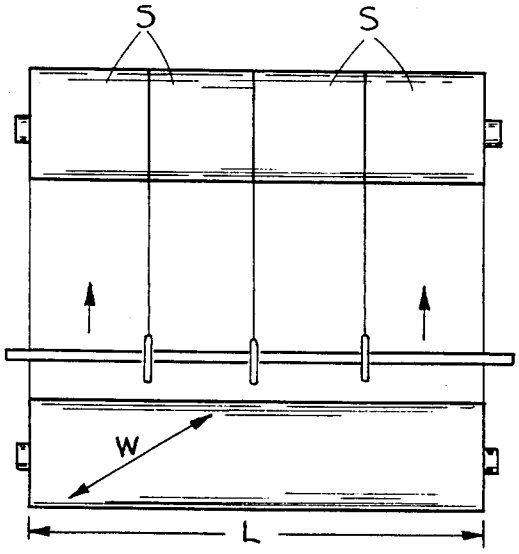
FIG. 2

FIG. 4
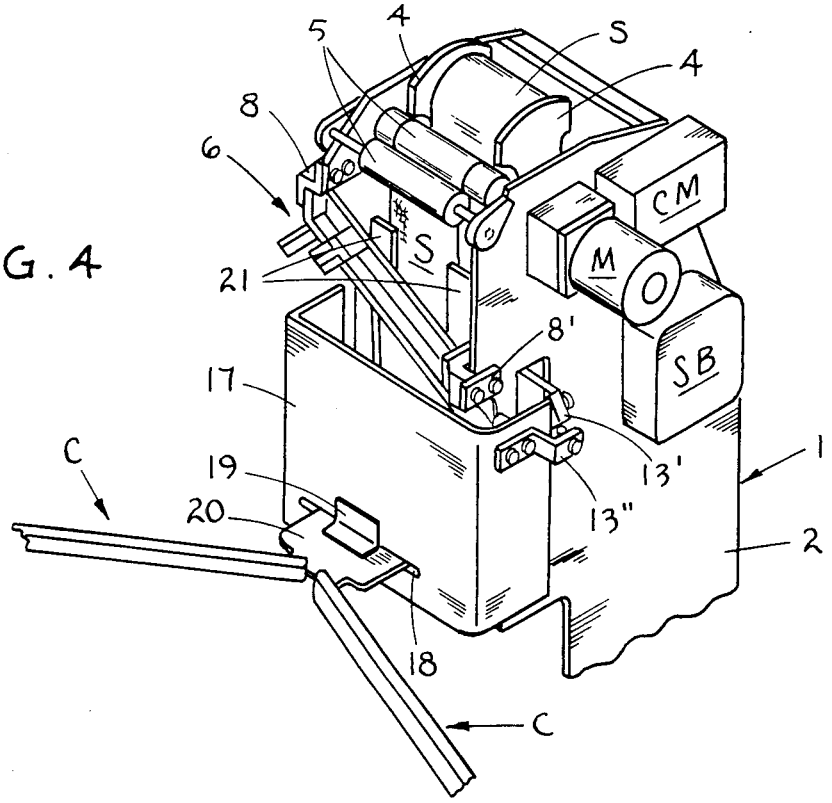
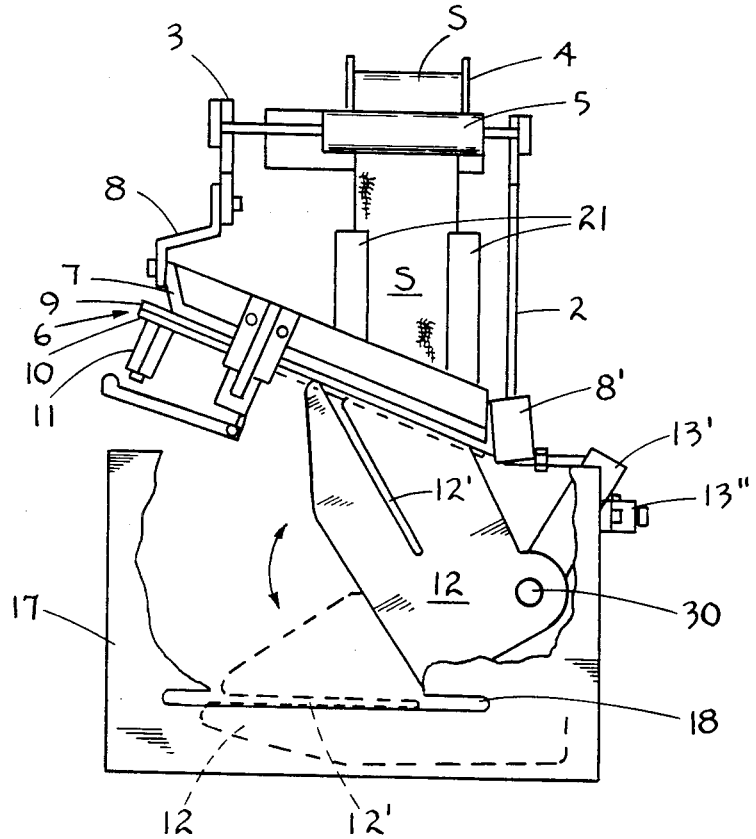
FIG. 5

METHOD AND APPARATUS FOR FORMING AND PRESENTING BIAS CUT GUSSETS IN THE FORMATION OF PANTY HOSE GARMENTS

This is a division of application Ser. No. 838,314 filed Mar. 10, 1986 now U.S. Pat. No. 4,640,162, dated Feb. 3, 1987.

BACKGROUND OF THE INVENTION

This invention relates to knitted garments and more particularly to the forming and handling of gussets or crotch pieces in which two knitted stocking blanks are combined with a gusset insert to provide a panty hose.

The patent to Cecil R. Bell, Jr. et al., U.S. Pat. No. 4,188,898, discloses a machine for attaching gussets to hosiery blanks wherein a cutting device severs gusset inserts from a gusset material supply and the severed inserts are placed in clamps prior to being sewn to slit hosiery blanks.

The patent to Osho Takatori, U.S. Pat. No. 4,267,785, also shows an apparatus somewhat similar to that of U.S. Pat. No. 4,188,898 but having an insert cutting and transferring device somewhat different therefrom.

U.S. Pat. No. 4,122,555 discloses the formation of a crotch insert by diagonally cutting a relatively narrow strip of fabric having selvage edges to form a diamond-shaped crotch insert. The wales are parallel with the selvage edges, and the diagonal lines of cut are at an angle of approximately 50° from the selvage edges.

The present invention relates to a new and improved system for forming gussets by cutting the gusset material in a prescribed manner and for presenting gussets to clamps in which they are held as they are sewn to hosiery blanks. The invention may be employed with machines of the type disclosed in above-mentioned U.S. Pat. Nos. 4,188,989 and 4,267,785, and reference may be made to the patents, if needed, for details of the clamps, sewing devices, hosiery blanks conveying apparatus, etc.

In the past, one method of producing gusset fabric consists of knitting tubular fabric, slitting the tubular fabric to open width, rolling the width of fabric into an elongated roll, and subsequently slitting the elongated roll into a series of narrow rolls, each having a width approximating the width or length of a gusset. In an effort to eliminate waste of the fabric, particularly at the ends of the open width rolls, the tubular knit fabric was cut on a spiral. However, this resulted in the wales of the gusset fabric being at an angle when sewn into the panty hose. It is significant to maintain the wales of a gusset insert running from leg to leg when the hosiery blanks and gusset are sewn together.

With the foregoing in mind, it is an object of the present invention to form diamond-shaped gussets from tubular fabric by cutting the fabric along a preselected bias angle such that the wales in each gusset insert run from leg to leg of a panty hose garment after the garment is sewn.

Another object of the invention is the provision of a new and improved system for presenting a gusset to a pair of hosiery blanks for subsequent sewing into a panty hose garment.

Other features and advantages of the invention will be readily apparent to those skilled in the art during the course of the following description of the invention.

BRIEF DESCRIPTION OF THE FIGURES

FIG. 1 is a view in perspective of a portion of knit tubular fabric illustrating the manner in which the fabric is initially bias cut into a relatively wide strip;

FIG. 2 is a view somewhat similar to FIG. 1 and illustrating the manner in which the relatively wide strip is severed into a plurality of narrow strips;

FIG. 3 is a schematic view illustrating the displacement and positioning of a gusset insert severed from a gusset fabric supply roll;

FIG. 4 is a perspective view of the mechanism for cutting and placing gussets in clamping arrangements prior to sewing to hosiery blanks;

FIG. 5 is a front elevational view of the apparatus of FIG. 4 with parts broken away to show clearly the cutting, orienting, and inserting features of the invention;

FIG. 7 is a perspective view of the orienting manifold having a gusset positioned thereon; and FIG. 8 is a top plan view of the gusset pusher plate and the actuator therefor.

DETAILED DESCRIPTION OF THE INVENTION

Figure 6:
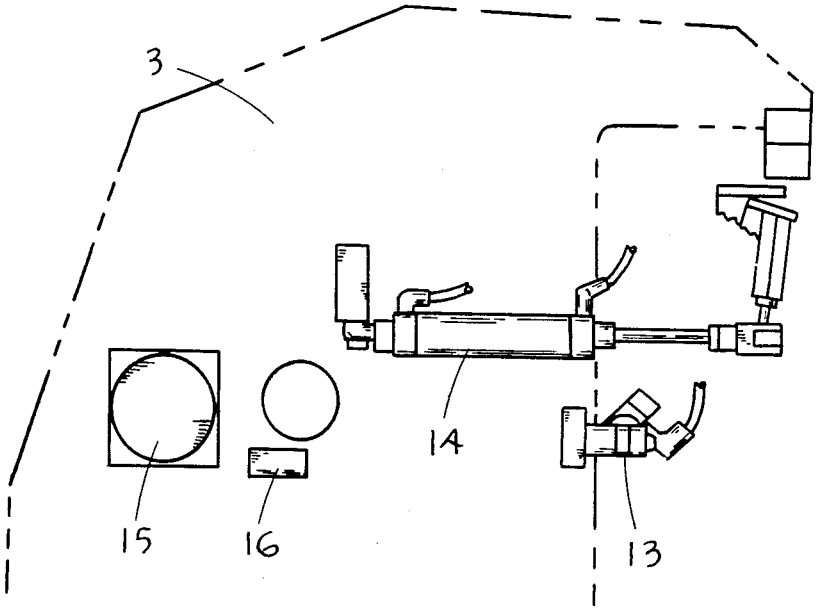
FIG. 6 is a fragmentary, schematic view from the left side of the apparatus showing the fluid motors for activating the shear assembly and the orienting assembly.

Referring initially to FIGS. 1 and 2, a continuous tube T of seamless knitted fabric is cut on a bias angle A and wound to produce a roll R of fabric having a preselected length L. The length L depends upon the width of the tubular fabric T. The roll is then slit and wound into a plurality of rolls S. The bias angle A may vary somewhat; however, in the preferred embodiment the angle is 30°. Narrow strips S could be cut from the tubular fabric if so desired rather than cutting a wide strip and subsequently slitting the wide strip into narrow strips.

The width of the rolls S may vary. However, in a preferred embodiment the rolls are approximately $3\frac{1}{4}$ inches wide.

Referring to FIGS. 3A–3D, gusset material is unwound from a roll S and intermittently severed at an angle B to define individual diamond-shaped gussets G. Each severed gusset is rotated from the FIG. 3B position to the FIG. 3C position before being advanced and oriented in a selected position for combining with two hosiery blanks. It is important that the wales of the fabric forming the gusset G run leg to leg of the panty hose garment.

The apparatus for cutting and orienting the gussets is illustrated by FIGS. 4–8.

As shown in FIG. 4, a frame generally shown at 1 is supported in a conventional manner upon a line closer machine of the type as disclosed, for example, by U.S. Pat. Nos. 4,188,898 and 4,267,785, and faces a clamping arrangement C, shown schematically, which corresponds to clamps 64 of U.S. Pat. No. 4,188,898. The frame 1 includes opposite vertically extending side members 2, 3 and a U-shaped front member 17 attached to said side members. Spaced upstanding plates 4 are attached to frame 1 by any conventional means for supporting a gusset material supply roll S. Gusset roll feed rolls 5, 5, a feed roll drive motor M, motor control means MC, a shearing assembly 6 and a gusset transferring and orienting manifold assembly are supported by members 2, 3, 17. Side plate 3, FIG. 6, also supports shear and manifold double-acting fluid cylinders 13 and 14 respectively, fluid motor controls means 15, and photocell or the like sensing means 16.

Located near the lower portion of U-shaped front member 16 is a slot 18 which is in alignment with clamps C and an L-shaped guide member 19. The L-shaped guide member 19 is attached to the member 17 with the free bottom surface substantially in alignment with a surface of member 17 which defines the upper portion of slot 18. A pusher plate 20, actuated by a double-acting fluid cylinder 20', is adapted to project through slot 18 and to the clamps C, FIG. 4.

As shown in FIGS. 4 and 5, the shear assembly 6 is specifically illustrated and includes anvil means 7, 9 fixed between frame members 2, 3 at 8, 8', and a shear blade 10 pivoted at 11 to anvil 9. Remote from pivot 11, shear fluid motor 14 is connected to shear blade 10 to move the blade to sever the gusset material extending downwardly from a supply roll S and between the anvil 9 and the open shear blade 10. Note that the shear blade 10 is moved in a direction into and out of the plane of paper as viewed in FIG. 2. Note also that the cutting edges of the blade and anvil are inclined downwardly at an angle, preferably about 30°, from the horizontal, and severs the gusset fabric at such an angle B along gusset edges E1, E2, FIG. 3B.

Pivotably mounted at 30 closely below the shearing assembly 6 is the transferring and oriienting manifold assembly 12, as shown in FIGS. 5 and 7. The assembly includes a box-like structure having a slot 12' extending diagonally through a major portion thereof. This slot is directed in the direction of the remote points of the diamond-shaped gusset; see FIG. 7. The manifold pivots between the full and broken line positions of FIG. 5 to transfer the gusset from the FIG. 3B to the FIG. 3C position. The rear portion 12" of the manifold has perforations therein, as shown by FIG. 7, for applying suction or vacuum thereto to support a gusset insert G thereon. A conventional means may be employed for applying suction to the manifold. The fluid cylinder 13, through lever arrangement 13', pivots manifold between the full and broken line positions of FIG. 5. A stop 13" limits upward movement of the manifold by engaging lever 13'. Slot 12' of the manifold, when in the lower position, is in alignment with slot 18 of the front member 17. The pusher plate 20 normally is withdrawn from slots 18, 12' and retracted to a position behind the manifold 12 but still aligned with slot 18.

Located between the shear and manifold assemblies and the feed rolls 5 are spaced U-shaped fabric guide members 21 which may be laterally adjustable for receiving various widths of gusset fabric.

Located on the frame 1 is a conventional sensing and control system to sense various conditions and control the various movements or motions of the above-described structure. For example, upon starting of the machine, the sensing and control means senses the presence or absence of gusset material in position to be severed. If no fabric is in place, feed rolls 5 are actuated to feed a predetermined length of material to and past the open shearing assembly at which time vacuum is applied to the back plate 12" of the manifold to attract the gusset material. The shear assembly is then actuated to sever the gusset material to define a gusset held upon the manifold plate 12". After severing, the manifold is rotated from the full to the broken line position, FIG. 5, with the slots 12' and 18 in alignment with each other and with the pusher plate 20. The vacuum is broken and the pusher plate 20 simultaneously actuated to push the gusset G, which is now folded around the forward edge of the plate 20, through slots 12, 18 and into clamps C where it is placed to be subsequently sewn to two hosiery blanks to define a panty hose garment. At this point the plate 20 is retracted and the manifold is pivoted back to the full line position, FIG. 5, at which time the entire sequence is automatically repeated.

The specific control means for the various functions are known in the art and form no part of the present invention apart from defining an operative device and presenting a complete disclosure.

What is claimed is:

1. The method of forming a gusset for combining with two circularly knit hosiery blanks in the formation of a lower body garment comprising the steps of: knitting a continuous tube of seamless fabric, severing the fabric in a prescribed manner to define a bias cut continuous fabric strip of a prescribed width, advancing a prescribed length of the fabric strip to a shear, and severing the strip at a preselected angle to define a diamond-shaped gusset having the wales of the fabric running parallel to a line extending from one point of the diamond shape to the diagonally opposite point.

2. The method as recited in claim 1, wherein said prescribed width fabric strip corresponds to the desired width of the gusset.

3. The method as recited in claim 1, wherein the tube of knit fabric is severed along a prescribed bias angle, wound into an elongated roll and the roll subsequently slit to define the fabric strip of a prescribed width.

4. The method as recited in claim 3, wherein the bias angle is approximately 30°.

5. The method as recited in claim 4 wherein the strip is severed at a preselected angle of approximately 30°.

6. The method as recited in claim 1, and further including the step of transferring and orienting the diamond-shaped gusset in a prescribed manner for subsequent attachment to two circularly knit hosiery blanks.

7. The method of forming a diamond-shaped gusset for subsequent sewing to knit hosiery blanks in the production of a panty hose garment comprising the steps of: cutting a circular knit tube of fabric to define a narrow strip of fabric having a width corresponding to the desired width of a gusset and with the wales of the fabric extending at a first preselected angle with respect to the length of the fabric strip, and severing the strip at a second preselected angle to define a diamond-shaped gusset with the fabric wales running parallel to a line extending from one point of the diamond shape to the diagonally opposite point.

8. The method as recited in claim 7, wherein the first preselected angle is approximately 30°.

9. The method as recited in claim 7, wherein the second preselected angle is approximately 30°.

* * * * *